US011303034B2

(12) United States Patent
Leung et al.

(10) Patent No.: US 11,303,034 B2
(45) Date of Patent: Apr. 12, 2022

(54) PARALLEL-PLATE ANTENNA

(71) Applicant: City University of Hong Kong, Kowloon (HK)

(72) Inventors: Kwok Wa Leung, Kowloon Tong (HK); Kai Lu, Shatin (HK)

(73) Assignee: City University of Hong Kong, Kowloon (HK)

( * ) Notice: Subject to any disclaimer, the term of this patent is extended or adjusted under 35 U.S.C. 154(b) by 195 days.

(21) Appl. No.: 16/715,104

(22) Filed: Dec. 16, 2019

(65) Prior Publication Data

US 2021/0184360 A1 Jun. 17, 2021

(51) Int. Cl.
*H01Q 13/18* (2006.01)
*H01Q 9/04* (2006.01)
*H01Q 1/24* (2006.01)

(52) U.S. Cl.
CPC ..... *H01Q 13/18* (2013.01); *H01Q 1/243* (2013.01); *H01Q 9/0428* (2013.01)

(58) Field of Classification Search
CPC ..... H01Q 19/028; H01Q 13/18; H01Q 1/243; H01Q 9/0428
See application file for complete search history.

(56) References Cited

U.S. PATENT DOCUMENTS 3,541,559 A 11/1970 Evens
4,062,019 A 12/1977 Woodward et al.
4,658,262 A 4/1987 DuHamel
4,958,165 A 9/1990 Axford
5,170,176 A 12/1992 Yasunaga
5,661,494 A 8/1997 Bondyopadhyay
6,166,709 A 12/2000 Goldstein
7,541,998 B1 6/2009 Chang et al.
2007/0176827 A1* 8/2007 Itoh ..... H01Q 13/206 343/700 MS
2009/0146883 A1* 6/2009 Chin ..... H01Q 9/045 343/700 MS
2011/0043414 A1* 2/2011 Webb ..... H01Q 17/001 29/601
2012/0212386 A1* 8/2012 Massie ..... H01Q 1/243 343/850
2016/0204514 A1* 7/2016 Miraftab ..... H01Q 21/005 343/731

FOREIGN PATENT DOCUMENTS

EP 0428299 A2 * 5/1991 ..... H01Q 13/10
KR 102196518 B1 * 12/2020

* cited by examiner

*Primary Examiner* — Graham P Smith
*Assistant Examiner* — Jae K Kim
(74) *Attorney, Agent, or Firm* — Renner Kenner Greive Bobak Taylor & Weber

(57) ABSTRACT

A parallel-plate antenna or antenna array suitable for operation at millimeter wave frequencies. The antenna includes an antenna element having a ground plane with a slot and a pair of parallel plates connected to the ground plane. The parallel plates extend generally perpendicularly from the ground plane. In plan view, the slot is arranged between the parallel plates. The antenna also includes a feed operably coupled with the slot for feeding the slot during operation so as to generate a circularly polarized signal for radiation.

23 Claims, 21 Drawing Sheets

XOZ Plane
θ = 0°
Normalized Patterns (dB)
24.4GHz
(-x)
(+x)
0
30°
60°
90°
120°
150°
180°
-10
-20
-30
-40
Simulated Gain_LHCP
Simulated Gain_RHCP YOZ Plane
θ = 0°
(-y)
(+y)
Measured Gain_LHCP
Measured Gain_RHCP XOZ Plane
θ = 0°

YOZ Plane
θ = 0°
Normalized Patterns (dB)
26GHz
(-x)
(+x)
(-y)
(+y)
0
30°
60°
90°
120°
150°
180°
-10
-20
-30
-40
Simulated Gain_LHCP
Simulated Gain_RHCP
Measured Gain_LHCP
Measured Gain_RHCP XOZ Plane
θ = 0°
Normalized Patterns (dB)
28.8GHz YOZ Plane
θ = 0°
(-x)
(+x)
(-y)
(+y)
0
30°
60°
90°
120°
150°
180°
-10
-20
-30
-40
Simulated Gain_LHCP
Simulated Gain_RHCP
Measured Gain_LHCP
Measured Gain_RHCP XOZ Plane
θ = 0°

YOZ Plane
θ = 0°
Normalized Patterns (dB)
24.8GHz
(-x)
(+x)
(-y)
(+y)
0
30°
60°
90°
120°
150°
180°
-10
-20
-30
-40
Simulated Gain_LHCP
Simulated Gain_RHCP
Measured Gain_LHCP
Measured Gain_RHCP XOZ Plane
θ = 0°

YOZ Plane
θ = 0°
Normalized Patterns (dB)
26GHz
(-x)
(+x)
(-y)
(+y)
0
30°
60°
90°
120°
150°
180°
-10
-20
-30
-40
Simulated Gain_LHCP
Simulated Gain_RHCP
Measured Gain_LHCP
Measured Gain_RHCP XOZ Plane
θ = 0°

YOZ Plane
θ = 0°
Normalized Patterns (dB)
28GHz
(-x)
(+x)
(-y)
(+y)
0
30°
60°
90°
120°
150°
180°
-10
-20
-30
-40
Simulated Gain_LHCP
Simulated Gain_RHCP
Measured Gain_LHCP
Measured Gain_RHCP

PARALLEL-PLATE ANTENNA

TECHNICAL FIELD

The invention relates to an antenna and particularly, although not exclusively, to a circularly polarized parallel plate antenna.

BACKGROUND

Circularly polarized antennas are a known type of antenna that finds use in complex wireless communication systems and mobile communications.

Broad-beam or low-gain circularly polarized antennas, such as the microstrip patch antenna (MPA) and dielectric resonator antenna (DRA) are widely used, e.g., in mobile communications. However, MPA and DRA at millimeter wave (mmWave) frequencies or frequency bands have drawbacks. For MPA, its radiation efficiency may be significantly reduced at mmWave frequencies due to the surface-wave, metallic, and dielectric losses. For DRA, this reduced efficiency problem is less severe. But DRA at mmWave frequencies or frequency bands are made small and hence may be difficult to make precisely. In fact, many existing circularly polarized broad-beam antennas in the mmWave bands are either complex hence expensive to make or has suboptimal performance perspective (such as low efficiency).

SUMMARY OF THE INVENTION

In a first aspect of the invention, there is provided an antenna including an antenna element and a feed. The antenna element includes a ground plane with a slot and a pair of parallel plates connected to the ground plane. The parallel plates extend generally perpendicularly from the ground plane. In plan view, the slot is arranged between the parallel plates. The antenna also includes a feed operably coupled with the slot for feeding the slot during operation so as to generate a circularly polarized signal for radiation. Preferably, the antenna has a working frequency, and the feed is arranged to feed the slot so as to create a phase difference between orthogonal modes of operation at the working frequency for generation of the circularly polarized signal. The two orthogonal modes may have respective resonant frequencies, one slightly above the working frequency, the other slightly below the working frequency. The antenna element could include one or more additional plates and/or slots. The antenna element may be sized in the order of centimeter (cm).

In one embodiment of the first aspect, the slot is elongated along a slot extension axis. For example, the slot can be generally rectangular, obround, or oblong (i.e., cross section in plan view). The slot may be quadrilateral or polygonal (i.e., cross section in plan view).

In one embodiment of the first aspect, each of the parallel plates has a length extending parallel to a plate extension axis, and the slot extension axis is at an angle with the plate extension axis. The angle may be between 30 degrees to 60 degrees, preferably between 40 degrees to 50 degrees, and more preferably about 45 degrees. The circularly polarization becomes more distinctive as the angle gets close to 45 degrees.

In one embodiment of the first aspect, the slot is arranged centrally of the ground plane. For example a center point of the slot may coincide with a center point of the ground plane in plan view.

In one embodiment of the first aspect, parallel plates are of the same shape and size. The parallel plates may be in the form of a rectangular prism or, preferably, a semi-circular prism. Semi-circular prism can produce cross polarized fields when compared with rectangular prism. Preferably, the parallel plates are generally symmetrically disposed with reference to the ground plane. Since the symmetry of the plates facilitates symmetry of the radiation pattern or signal thereby lowering cross polarization components.

In one embodiment of the first aspect, the ground plane defines a footprint, and, in plan view, the parallel plates and the feed are within the footprint. This arrangement provides a compact antenna.

In one embodiment of the first aspect, the ground plane has a top from which the parallel plates extend, and a bottom, wherein the bottom of the ground plane defines a cavity, the cavity at least partly receiving the feed.

In one embodiment of the first aspect, the feed include a waveguide-to-coaxial adapter including a feed waveguide and a feed probe attached to the feed waveguide. The feed waveguide may have opposite first and second ends. For example, the first end is received in the cavity and the second end is a shorted-end. The feed waveguide may extend generally perpendicular to the ground plane, and the feed probe may extend generally parallel to the ground plane. Preferably, the feed probe is connected between the first and second ends of the feed waveguide.

In one embodiment of the first aspect, the antenna element is integrally formed.

In one embodiment of the first aspect, the antenna element is metallic. The antenna element may be moulded or additively manufactured. The use of metal provides high radiation efficiency and a simple way of manufacture.

In one embodiment of the first aspect, the antenna is adapted for operation in the mmWave band, in particular the 5G mmWave band, such as the 26 GHz and 28 GHz bands.

In a second aspect of the invention, there is provided an antenna array including a plurality of the antennas of the first aspect.

In a third aspect of the invention, there is provided a communication device including one or more of the antennas of the first aspect. The communication device may be a mobile phone, a computer, a tablet, a smart device, an IoT device, etc.

In a fourth aspect of the invention, there is provided an antenna array including an antenna element array and one or more feeds. The antenna array includes a ground plane, three or more parallel plates connected to the ground plane, and a plurality of slots formed in the ground plane. The parallel plates extend generally perpendicularly from the ground plane. Each of the slots is arranged between adjacent parallel plates of the three or more parallel plates. The one or more feeds are operably coupled with the plurality of slots for feeding the slots during operation so as to simultaneously generate a plurality of circularly polarized signals for radiation.

In one embodiment of the fourth aspect, each of the one or more slots is elongated along a slot extension axis. For example, the slot can be generally rectangular, obround, or oblong (i.e., cross section in plan view). The slot may be quadrilateral or polygonal (i.e., cross section in plan view). The one or more slots may be identical.

In one embodiment of the fourth aspect, each of the parallel plates has a length extending parallel to a plate extension axis, and the slot extension axis is at an angle with the plate extension axis. The angle may be between 30 degrees to 60 degrees, preferably between 40 degrees to 50 degrees, and more preferably about 45 degrees. The circularly polarization becomes more distinctive as the angle gets close to 45 degrees.

In one embodiment of the fourth aspect, the slot is arranged centrally of the ground plane. For example, a center point of the slot may coincide with a center point of the ground plane in plan view.

In one embodiment of the fourth aspect, parallel plates are of the same shape and size. The parallel plates may be in the form of a rectangular prism or, preferably, a semi-circular prism. Semi-circular prism can produce cross polarized fields when compared with rectangular prism.

In one embodiment of the fourth aspect, the ground plane defines a footprint, and, in plan view, the parallel plates and the feed are within the footprint. This arrangement provides a compact antenna.

In one embodiment of the fourth aspect, the ground plane has a top from which the parallel plates extend, and a bottom, wherein the bottom of the ground plane defines a cavity, the cavity at least partly receiving the one or more feeds.

In one embodiment of the fourth aspect, the one or more feeds each includes a waveguide-to-coaxial adapter including a feed waveguide and a feed probe attached to the feed waveguide. The feed waveguide may have opposite first and second ends. For example, the first end is received in the cavity and the second end is a shorted-end. The feed waveguide may extend generally perpendicular to the ground plane, and the feed probe may extend generally parallel to the ground plane. Preferably, the feed probe is connected between the first and second ends of the feed waveguide.

In one embodiment of the fourth aspect, the antenna element array is integrally formed.

In one embodiment of the fourth aspect, the antenna element array is metallic. The antenna element array may be moulded or additively manufactured.

In one embodiment of the fourth aspect, the antenna array is adapted for operation in the mmWave band, in particular the 5G mmWave band, such as the 26 GHz and 28 GHz bands.

In a fifth aspect of the invention, there is provided an antenna element for an antenna. The antenna element includes a ground plane with a slot and a pair of parallel plates connected to the ground plane. The parallel plates extend generally perpendicularly from the ground plane, and, in plan view, the slot is arranged between the parallel plates. The slot is arranged to be operably connected with a feed that feeds the slot during operation so as to generate a circularly polarized signal for radiation. The antenna element may be the antenna element of the first aspect.

In a sixth aspect of the invention, there is provided a method of making the antenna, including: determining one or more operation parameters of the antenna; and forming the antenna based on the one or more operation parameters. The antenna may be the antenna of the first aspect.

In one embodiment of the sixth aspect, the one or more operation parameters include one or more of: a working frequency of the antenna, an impedance frequency of the antenna, and an impedance matching of the antenna. Preferably, the impedance matching and axial ratio can be tuned separately.

In one embodiment of the sixth aspect, forming the antenna comprises moulding the antenna element.

In one embodiment of the sixth aspect, forming the antenna comprises additively manufacturing the antenna element.

In one embodiment of the sixth aspect, forming the antenna further comprises attaching the feed to the antenna element.

In one embodiment of the sixth aspect, a separation between the parallel plates in plan view affects the working frequency.

In one embodiment of the sixth aspect, each of the parallel plates is in the form of a semi-circular prism, and wherein a radius of the semi-circular prism affects the working frequency.

In one embodiment of the sixth aspect, the slot is elongated with a length, and the length affects the impedance frequency In one embodiment of the sixth aspect, a distance between the first and second ends of the feed waveguide affects the impedance matching.

In one embodiment of the sixth aspect, the angle between the slot extension axis and the plate extension axis affects the working frequency and the impedance matching.

BRIEF DESCRIPTION OF THE DRAWINGS

Embodiments of the invention will now be described, by way of example, with reference to the accompanying drawings in which.

DETAILED DESCRIPTION

Figure 1C:
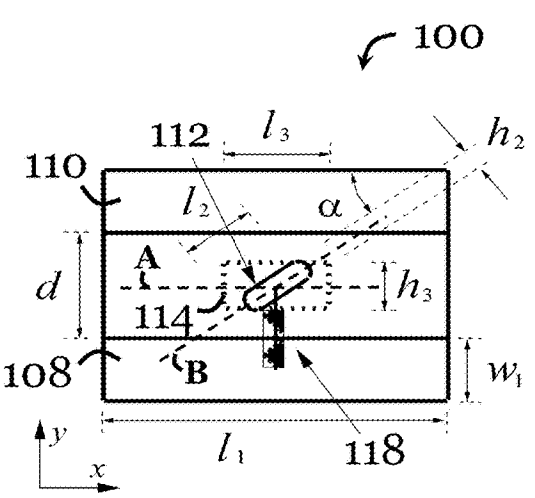
FIG. 1C is a top view of the parallel-plate antenna of FIG. 1A.
Figure 1B:
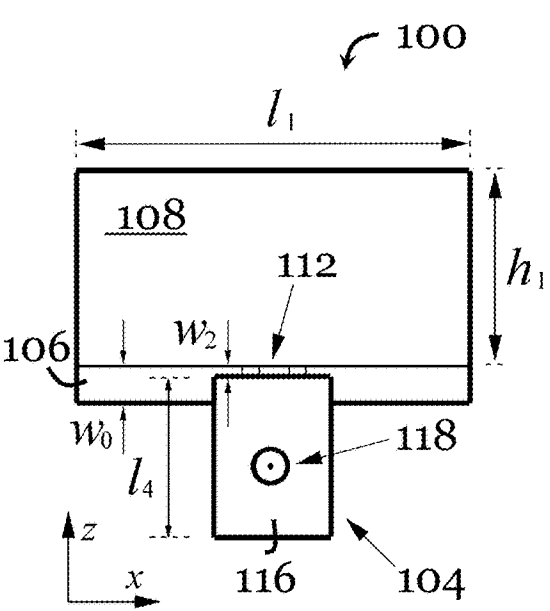
FIG. 1B is a front view of the parallel-plate antenna of FIG. 1A.
Figure 1A:
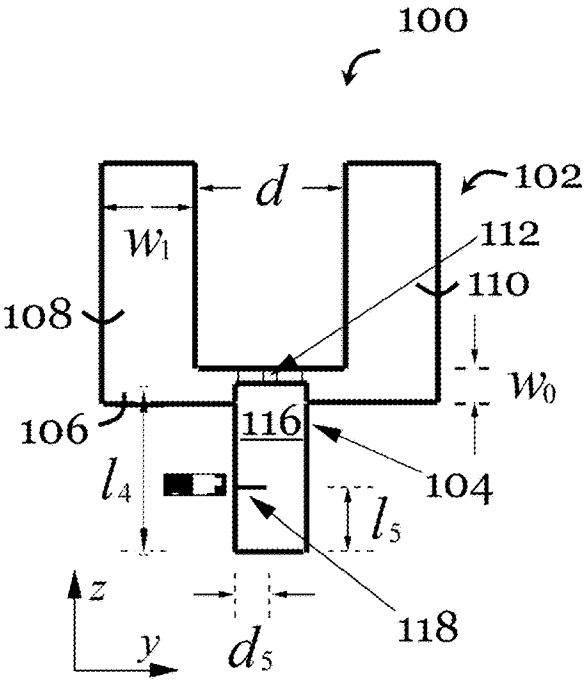
FIG. 1A is a side view of a parallel-plate antenna in one embodiment of the invention.

FIGS. 1A to 1C show a circularly polarized parallel-plate antenna too in one embodiment of the invention. The antenna too generally includes an antenna element 102 and a feed 104.

The antenna element 102 is formed by a horizontal ground plane 106 with thickness $w_0$ and a pair of vertical plates 108, 110. The antenna element 102 may be integrally formed using metal. The pair of vertical plates 108, 110, generally of the same shape and size (rectangular prism), and arranged in parallel, extend from the top of the ground plane 106 on two sides of the ground plane 106. Each of the vertical plates 108, 110 has a length 11, a height $h_1$, and a thickness $w_1$. FIG. 1A shows the parallel plates 108, 110 disposed generally symmetrically about a vertical plane bisecting the ground plane 106. In this example, $l_1/h_1=2$. The length $l_1$ extends parallel to a plate extension axis A. The vertical plates 108, 110 each includes a respective inner surface facing each other and spaced apart by a distance d. As best shown in FIG. 1C, the center of the ground plane 106 has a slot 112 that is arranged between the two parallel plates 108, 110 in plan view. The slot 112 is elongated with a generally rectangular cross section in plan view (chamfered at the four corners). The slot 112 has a length $l_2$ extending along a slot extension axis B, a width $h_2$, and a thickness $w_2$. The slot 112 is "inclined" at an angle $\alpha$, which is the angle between the plate extension axis A and the slot extension axis B. The slot 112 is configured to be fed by the feed 104 to generate circularly polarized fields in the antenna 100. For the best effect of circular polarization, the angle $\alpha$ is preferably near about 45 degrees, for example, between 30 degrees to 60 degrees. The bottom of the ground plane 106, in a location corresponding to the slot 112 in plan view, defines a cavity that receives and couples with the feed 104.

The feed 104 is connected to the ground plane 106, at its bottom, and received in the cavity. The feed 104 can operably couple with the slot 112 for feeding the slot 112 during operation so as to generate a circularly polarized signal (e.g., wave, patterns, or the like) for radiation. The feed 104 in this embodiment is a waveguide-to-coaxial adapter. The adapter 104 forms a cavity-backed slot radiator. The adapter 104 is formed by a feed waveguide 116 and a feed probe 118 attached to the feed waveguide. The feed waveguide 116 has a first end received in the cavity and a second, opposite end forming a shorted-end. The feed waveguide 116 elongates perpendicular to the ground plane 106, with a length $l_4$, which can be adjusted for impedance matching. The feed probe 118, in the form of a co-axial feed, extends parallel to the ground plane 106. The feed probe 118 is connected between the first and second ends of the feed waveguide 116. Specifically, the feed probe 118 has length $d_5$, which has an offset of length $l_5$ from the shorted-end of the waveguide. As shown in FIG. 1C, the dimension of the aperture of the feed waveguide 116 is $l_3 \times h_3$. The parallel plates 108, 110 and the feed 104 are all within the footprint of the ground plane 106.

In this embodiment, the antenna 100 has a working frequency, e.g., in the mmWave band. During operation, the feed 104 is arranged to feed the slot 112 so as to create a phase difference between orthogonal modes of operation at the working frequency for generation of the circularly polarized signal for radiation. The two orthogonal modes have respective resonant frequencies, one slightly above the working frequency and one slightly below the working frequency.

Figure 2:
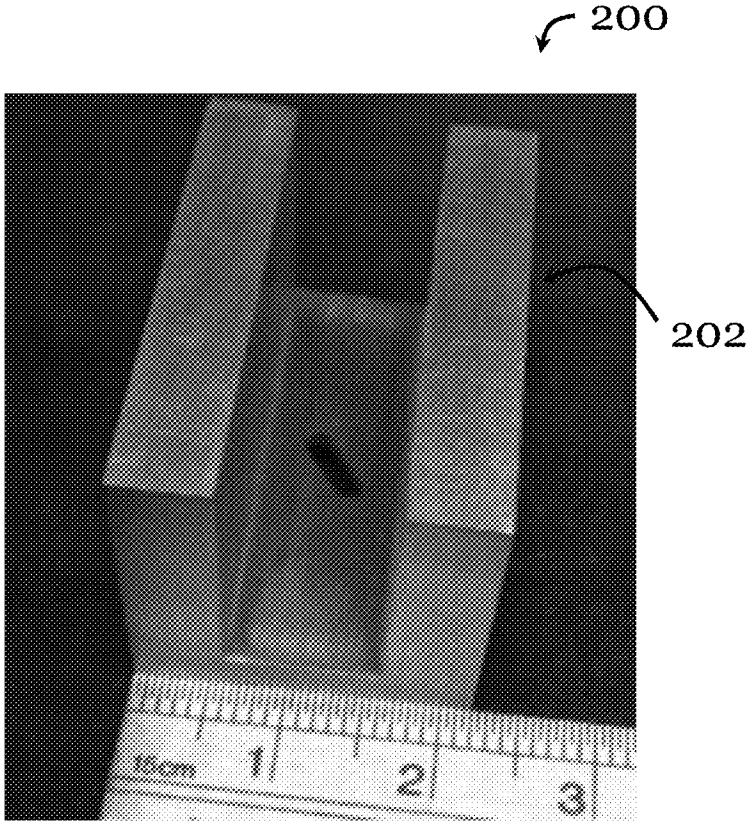
FIG. 2 is a photograph of an antenna element of a parallel-plate antenna fabricated based on the parallel-plate antenna of FIG. 1A.

FIG. 2 shows an antenna element 202 of a parallel-plate antenna 200, fabricated based on the design of FIGS. 1A to 1C. FIG. 2 does not show the feed. The antenna 200 in FIG. 2 was designed to have a working frequency of 26 GHz (the 26 GHz band), a typical 5G mmWave band. The waveguide inner dimensions are chosen with reference to the Electronic Industries Alliance (EIA) standard WR34, corresponding to a working frequency at the 26 GHz band. The design was simulated with ANSYS HFSS and the optimized parameters are as follows (for 26 GHz band): $w_0$=4.0 mm, d=10.0 min, $l_1$=33.2 min, $h_1$=16.6 mm, $w_1$=6.0 mm, 12=6.3 mm, $h_2$=2.0 mm, $w_2$=1.0 mm, $\alpha$=36°, $l_3$=8.64 mm, $h_3$=4.32 mm, $l_4$=12.0 mm, $d_5$=2.35 mm, and $l_5$=2.50 mm.

Simulations and experiments were performed on the antenna 200. In the measurement, the reflection coefficient was measured with an HP8510C vector network analyzer, the radiation patterns and antenna gains were measured with a near-field measurement system from Near-field System Incorporation (NSI).

Figure 3:
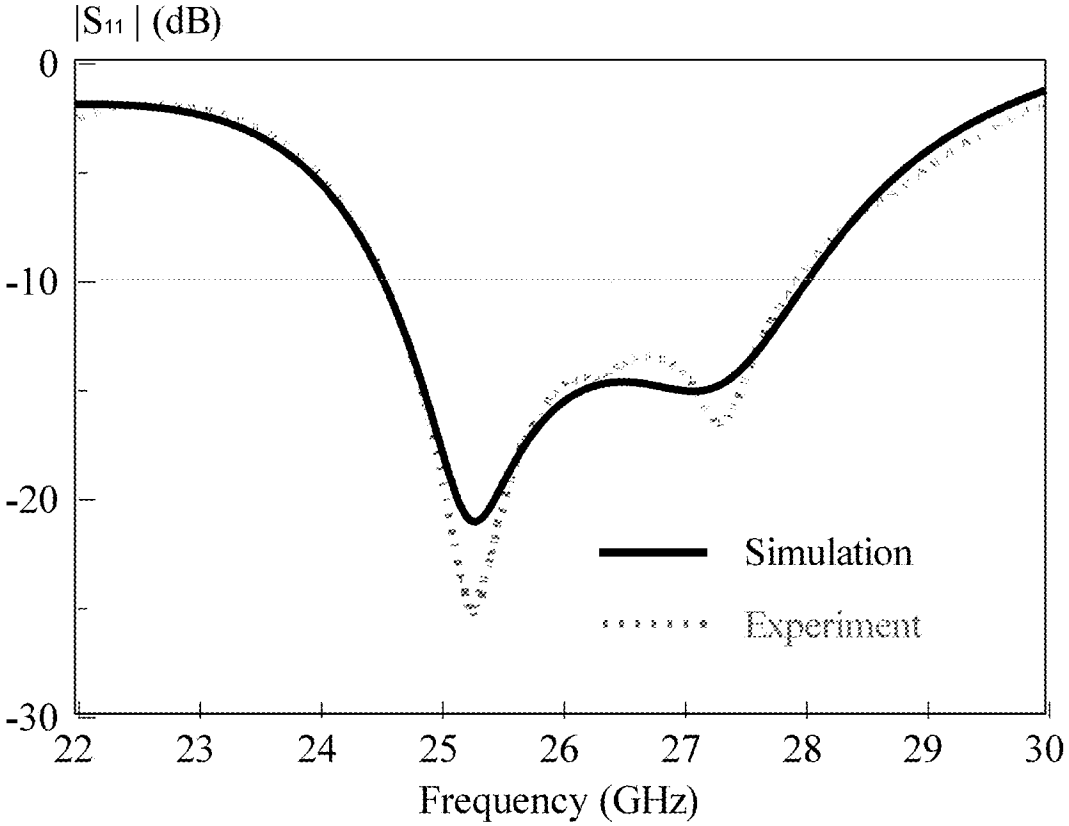
FIG. 3 is a graph showing measured and simulated reflection coefficients (dB) of the parallel-plate antenna of FIG. 2 at different frequencies (GHz)

FIG. 3 shows the measured and simulated reflection coefficients of the antenna 200. As shown in FIG. 3, there are two simulated resonant modes (min. $|S_{11}|$) at 25.3 GHz and 27.1 GHz. These two modes are caused by the resonance of the slot at the presence of the parallel-plate structure and waveguide-to-coaxial adapter cavity. It was found that when the parallel plates are removed, only a single resonant mode is obtained, at 26.5 GHz. This frequency is close to the mean value (26.3 GHz) of the two simulated resonance frequencies (25.3 GHz and 27.1 GHz). FIG. 3 shows that two measured resonance frequencies are 25-3 GHz and 27.3 GHz, which generally match with the simulation results. The measured and simulated 10-dB impedance bandwidths are 13.3% (24.5-28.0 GHz) and 13.7% (24.5-28.1 GHz), respectively.

Figure 4:
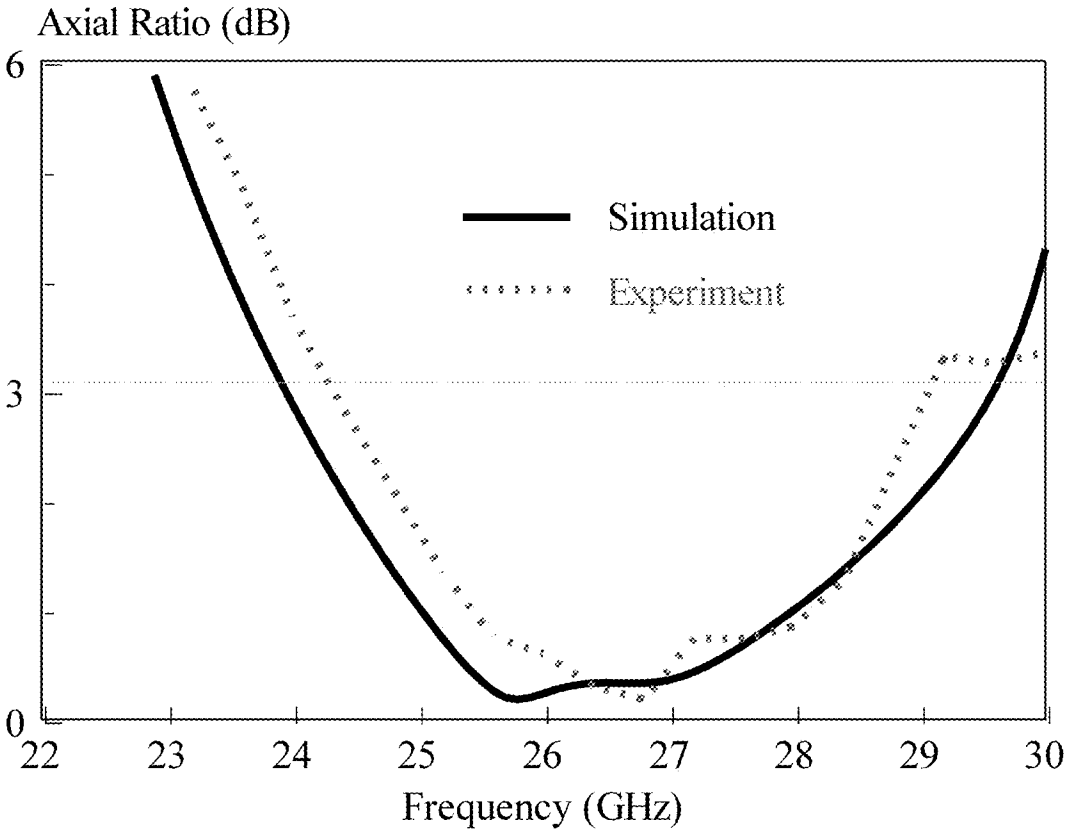
FIG. 4 is a graph showing measured and simulated axial ratios (dB) of the parallel-plate antenna of FIG. 2 at different frequencies (GHz)

FIG. 4 shows the measured and simulated axial ratios (ARs) of the antenna 200 in the boresight direction ($\theta=0°$. As shown in FIG. 4, the measured and simulated 3-dB AR bandwidths ($|AR|\leq 3$ dB) are 17.6% (24.3-29.0 GHz) and 20.6% (24.0-29.5 GHz), respectively. These bandwidths entirely cover the 10-dB impedance bandwidth, making the impedance bandwidth fully usable.

Figure 5:
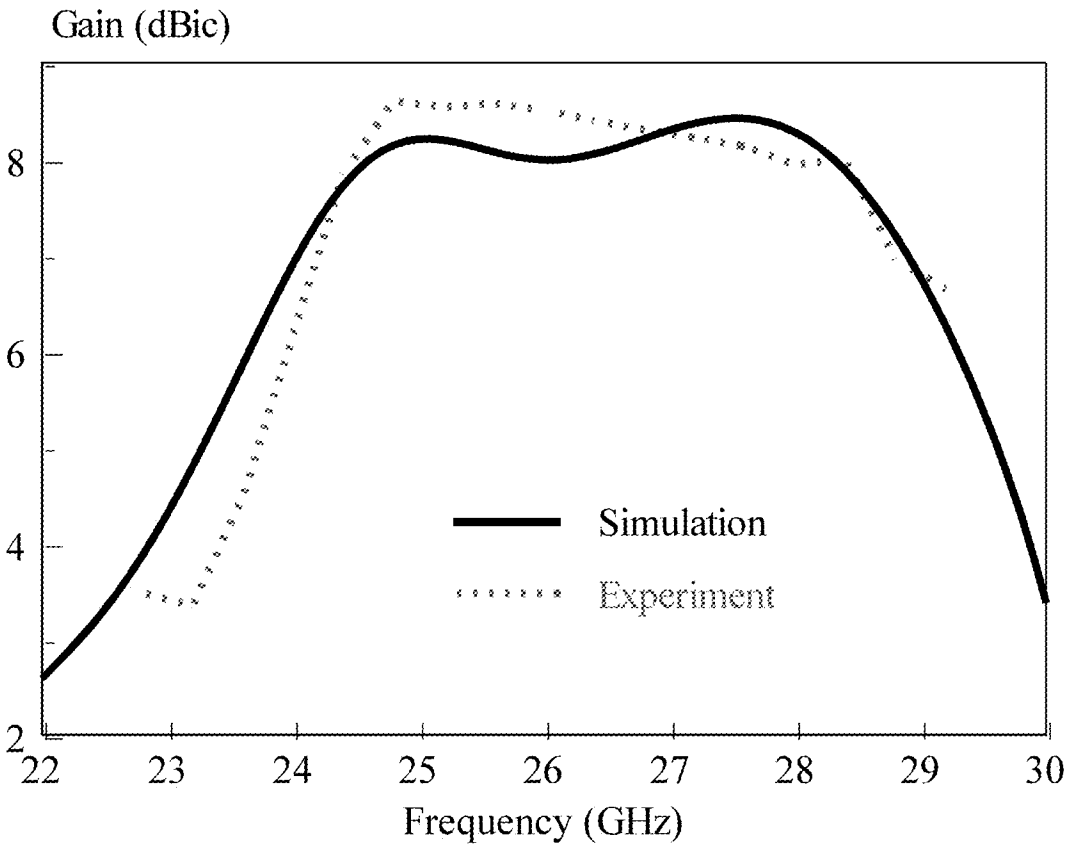
FIG. 5 is a graph showing measured and simulated antenna gain (dBic) of the parallel-plate antenna of FIG. 2 at different frequencies (GHz)

FIG. 5 shows the measured and simulated realized boresight gains ($\theta=0°$ (included impedance mismatch) for the antenna 200. The discrepancy between the measured and simulated results is likely caused by experimental tolerances. As shown in FIG. 5, the impedance bandwidth (24.5-28.1 GHz) falls within the 3-dB gain bandwidth. The maximum measured gain of 8.6 dBic is found at 24.8 GHz.

Figures 6A, 6B:
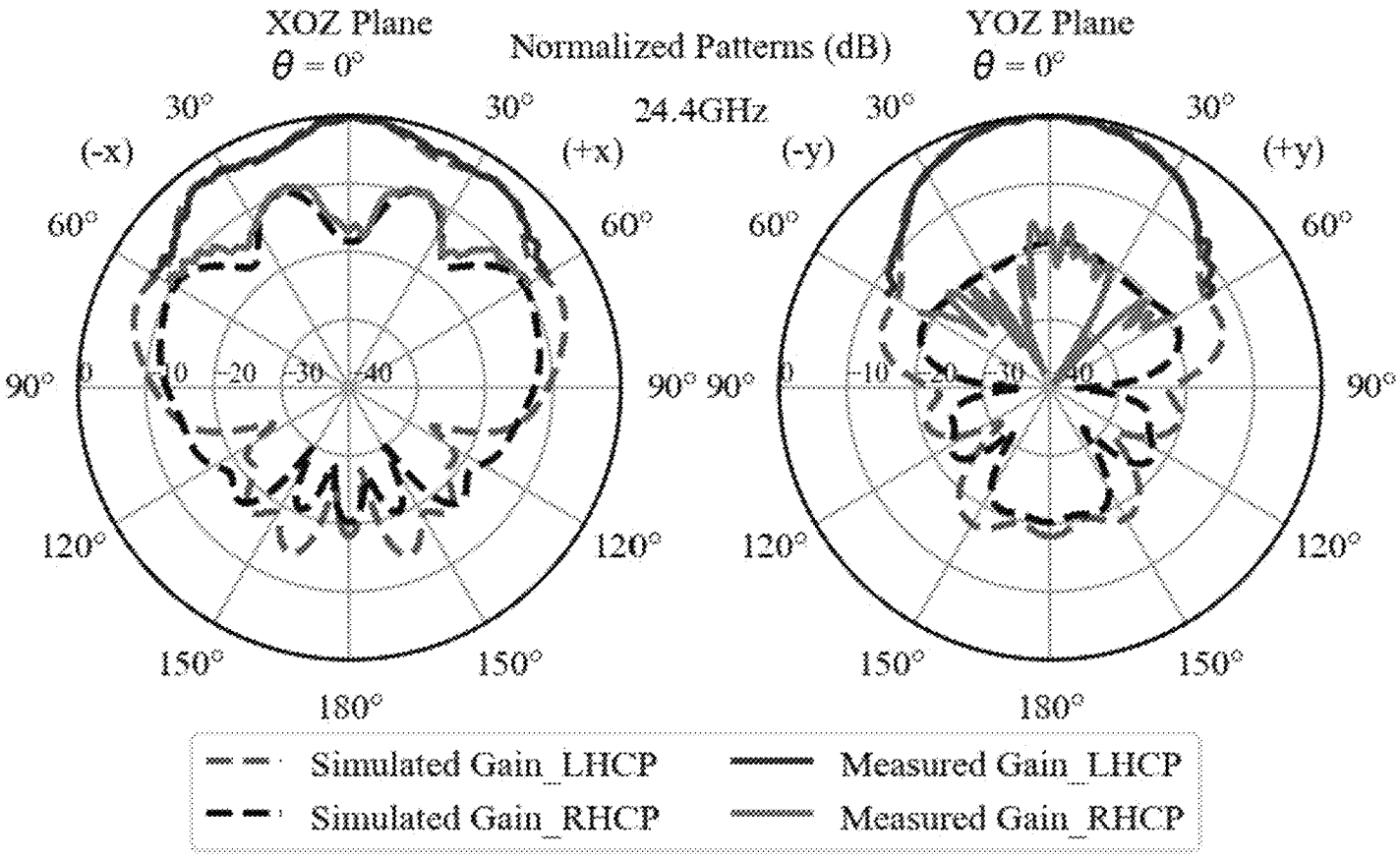
FIG. 6A is a plot showing measured and simulated radiation patterns of the parallel-plate antenna of FIG. 2 in the XOZ plane at 24.4 GHz.
FIG. 6B is a plot showing measured and simulated radiation patterns of the parallel-plate antenna of FIG. 2 in the YOZ plane at 24.4 GHz.
Figures 7A, 7B:
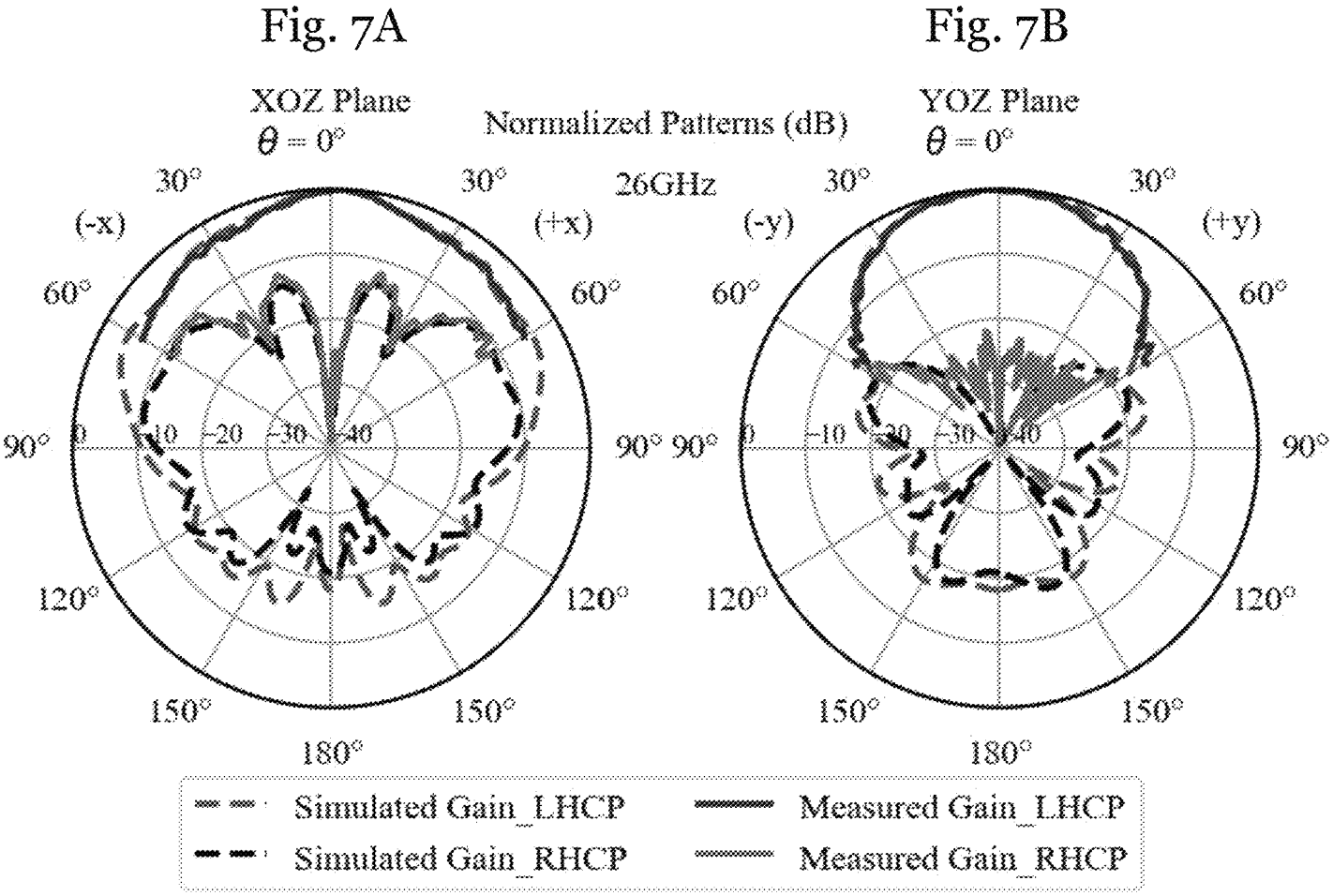
FIG. 7A is a plot showing measured and simulated radiation patterns of the parallel-plate antenna of FIG. 2 in the XOZ plane at 26 GHz.
FIG. 7B is a plot showing measured and simulated radiation patterns of the parallel-plate antenna of FIG. 2 in the YOZ plane at 26 GHz.
Figures 8A, 8B:
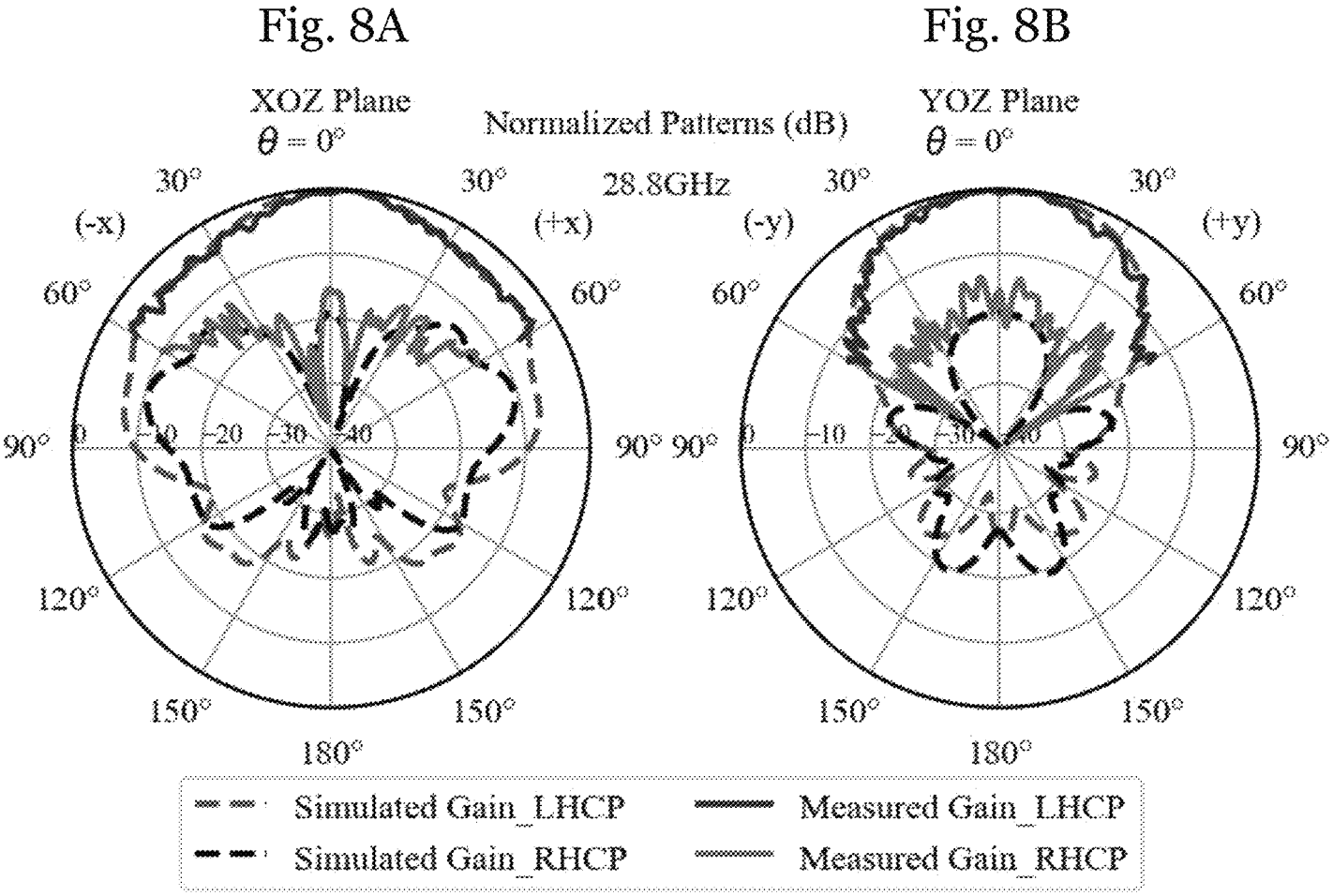
FIG. 8A is a plot showing measured and simulated radiation patterns of the parallel-plate antenna of FIG. 2 in the XOZ plane at 28.8 GHz.
FIG. 8B is a plot showing measured and simulated radiation patterns of the parallel-plate antenna of FIG. 2 in the YOZ plane at 28.8 GHz.

FIGS. 6A and 6B show the measured and simulated radiation patterns of the antenna 200 in the XOZ plane and the YOZ plane respectively, at 24.4 GHz; FIGS. 7A and 7B show the measured and simulated radiation patterns of the antenna 200 in the XOZ plane and the YOZ plane respectively, at 26 GHz; FIGS. 8A and 8B show the measured and simulated radiation patterns of the antenna 200 in the XOZ plane and the YOZ plane respectively, at 28.8 GHz.

Referring to FIGS. 6A and 6B, for the $\phi=0°$ plane at 24.4 GHz, each side of the radiation pattern has a local maximum at $\theta\sim 40°$ due to corner diffractions of the parallel plates. The $\phi=0°$ plane local maximum becomes smaller as the frequency increases to 26 GHz (FIGS. 7A and 7B) and finally becomes unnoticeable at 28.8 GHz (FIGS. 8A and 8B). For simplicity, only the patterns at 26 GHz shown in FIGS. 7A and 7B will be discussed in detail below.

With reference to FIGS. 7A and 7B, measured 3-dB co-polar beam-widths of 45° and 56° are obtained in the $\phi=0°$ and $\phi=90°$ planes, respectively, although the beam in the $\phi=0°$ plane looks wider than that in the $\phi=90°$ plane. As shown in FIGS. 7A and 7B, the left-hand circularly polarized (co-polar) field in the boresight direction ($\theta=0°$ is stronger than the right-hand circularly polarized (cross-polar) counterpart by more than 25 dB. Also, the cross-polar field in the $\phi=0°$ plane is significant at around $\theta=20°$ and 60°, which is generally undesirable for a broad-beam antenna. It is known that the axial ratio is 3 dB when the co-polar field is stronger than the cross-polar field by 15 dB. Based on this fact, the axial ratio can be determined from the co- and cross-polar fields of the radiation patterns and will not be provided here. As seen from FIGS. 7A and 7B, the measured 3-dB axial ratio beam-widths in the $\phi=0°$ and $\phi=90°$ planes are 18° and 93°, respectively. The former beam-width is much narrower than the latter because the length of the parallel-plate-waveguide aperture (space between the plates) is much larger than the width of the aperture in addition to the strong cross polarization in the $\phi=0°$ plane.

Figure 9:
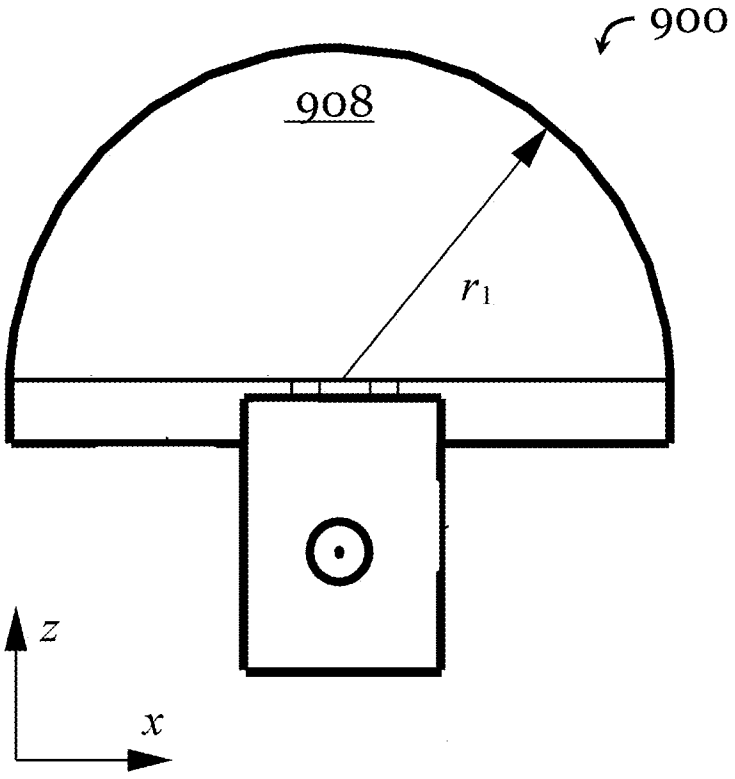
FIG. 9 is a front view of the parallel-plate antenna in another embodiment of the invention.

FIG. 9 shows a circularly polarized parallel-plate antenna 900 in another embodiment of the invention. The antenna 900 in this embodiment is generally identical to the antenna 100 of FIGS. 1A to 1C, except that the pair of vertical plates 108, 110 are not in the form of rectangular prisms but semicircular prisms. In the antenna 100 of FIGS. 1A to 1C, the plates 108, 110 in the form of rectangular prisms are suited for use when the incident wave is a plane wave. However, in the region bounded by the parallel plates 108, 110, the wave or signal from the slot resembles more closely to a generally cylindrical wave than a plane wave. The mismatch between the wave front and the shape of the plates may affect performance of the antenna 100. The plates 908 (only one plate shown, both plates are of identical form and size) in the form of semicircular prisms in this embodiment can alleviate these problems. The antenna 900 shares the same side and top views as the antenna 100 of FIGS. 1A to 1C, and shares the same parameters notations, except that $l_1$ now becomes $2r_1$. Since the radiation aperture, defined between the plates 908, is semicircular, distances from the slot center to a circumference of the radiation aperture are now equal. This improves the radiation pattern in some applications.

Figure 10:
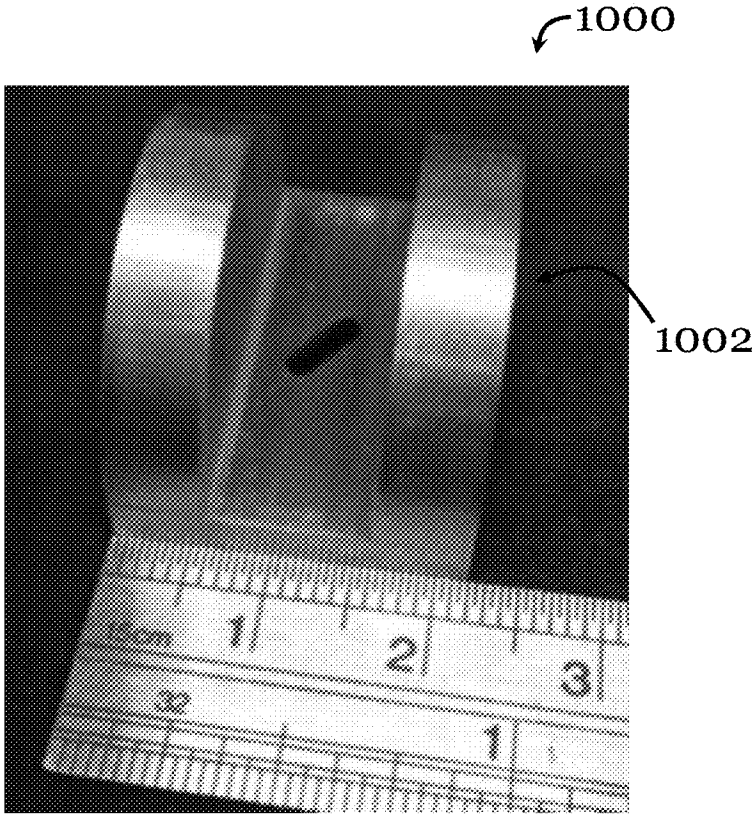
FIG. 10 is a photograph of an antenna element of a parallel-plate antenna fabricated based on the parallel-plate antenna of FIG. 9.

FIG. 10 shows an antenna element 1002 of a parallel-plate antenna 1000, fabricated based on the design of FIG. 9. FIG. 10 does not show the feed. The antenna 1000 in FIG. 10 was designed to have a working frequency of 26 GHz (the 26 GHz band), a typical 5G mmWave band. The waveguide inner dimensions are chosen with reference to the Electronic Industries Alliance (EIA) standard WR34, corresponding to a working frequency at the 26 GHz band. The design was simulated with ANSYS HFSS and the optimized parameters are as follows (for 26 GHz band): $w_0=4.0$ mm, d=10.0 mm, $r_1=14.5$ mm, $w_1=6.0$ mm, $l_2=6.3$ mm, $h_2=2.0$ mm, $w_2=1.0$ mm, $\alpha=36°$, $l_3=8.64$ mm, $h_3=4.32$ mm, $l_4=12.0$ mm, $d_5=2.35$ mm, and $l_5=2.50$ mm (except $r_1$, refer to the corresponding parts of FIGS. 1A to 1C).

Simulations and experiments were performed on the antenna 1000. In the measurement, the reflection coefficient was measured with an HP8510C vector network analyzer, the radiation patterns and antenna gains were measured with a near-field measurement system from Near-field System Incorporation (NSI).

Figure 11:
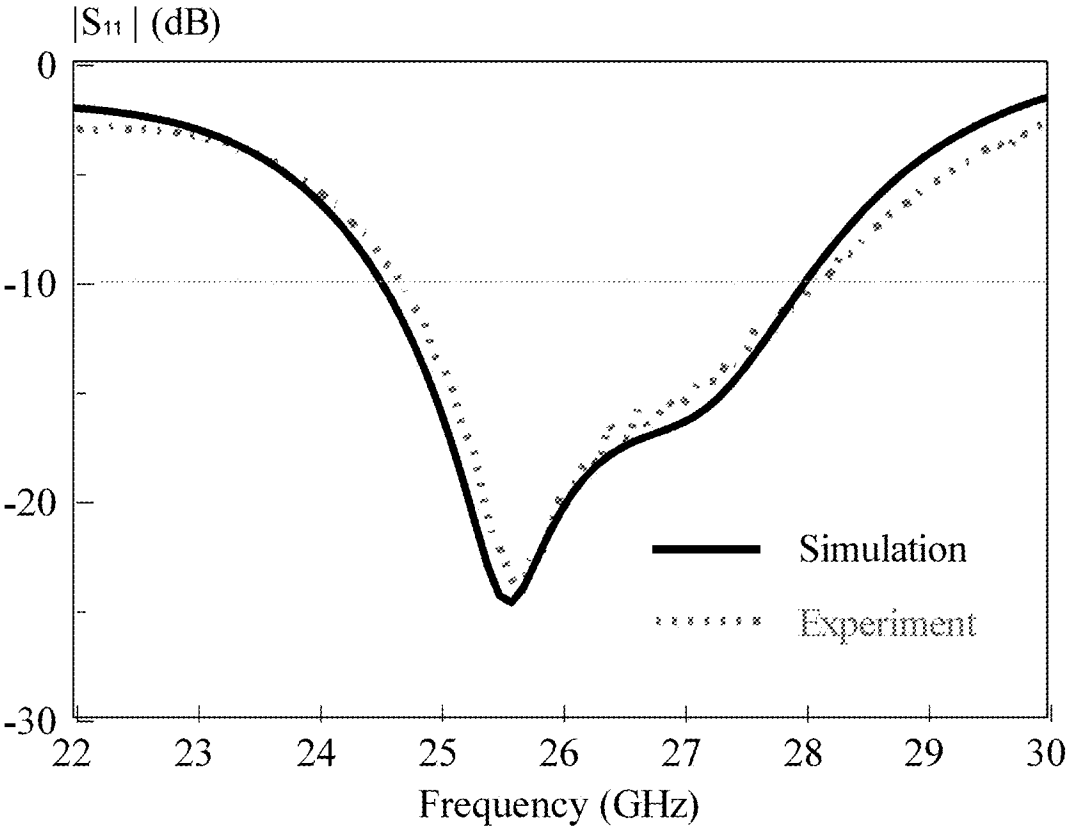
FIG. 11 is a graph showing measured and simulated reflection coefficients (dB) of the parallel-plate antenna of FIG. 9 at different frequencies (GHz)

FIG. 11 shows the measured and the simulated reflection coefficients of the antenna 1000. As shown in FIG. 11, two resonant modes are observed again at around 26.5 GHz but the second mode is not as strong as in the case of the antenna 200. For the first resonant mode, the measured and simulated resonance frequencies are 25.7 GHz and 25.6 GHz, respectively. The measured and the simulated 10-dB impedance bandwidths are 12.5% (24.7-28.0 GHz) and 12.9% (24.6-28.0 GHz), respectively.

Figure 12:
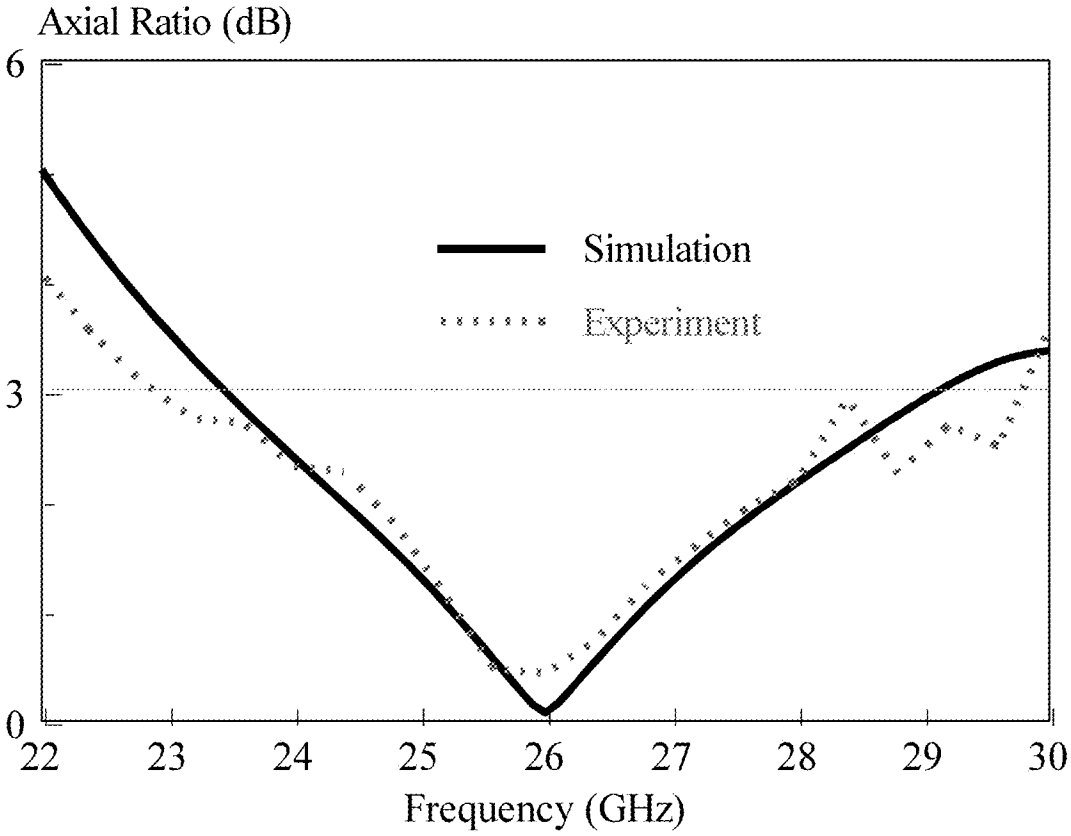
FIG. 12 is a graph showing measured and simulated axial ratios (dB) of the parallel-plate antenna of FIG. 9 at different frequencies (GHz)

FIG. 12 shows the measured and the simulated axial ratios of the antenna 1000. As shown in FIG. 12, the measured and simulated 3-dB axial ratio bandwidths are 26.2% (22.9-29.8 GHz) and 21.3% (23.5-29.1 GHz), respectively. It is noted that the measured axial ratio bandwidth desirably covers the entire measured impedance bandwidth.

Figure 13:
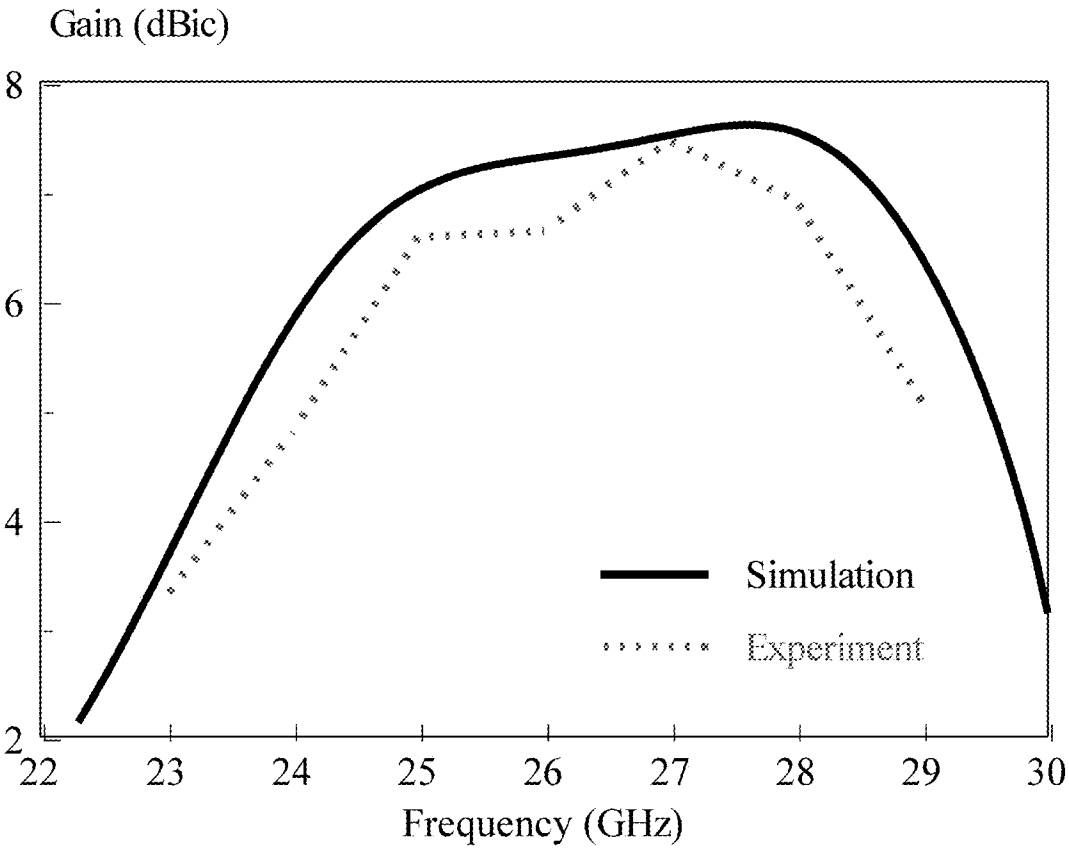
FIG. 13 is a graph showing measured and simulated antenna gains (dBic) of the parallel-plate antenna of FIG. 9 at different frequencies (GHz)

FIG. 13 shows the measured and simulated realized antenna gains in the boresight direction for the antenna 1000. As shown in FIG. 13, the measured gain is maximum (7.5 dBic) at 27.0 GHz. Like the measured axial ratio bandwidth, the measured 3-dB gain bandwidth also entirely covers the impedance bandwidth (24.7-28.0 GHz). Therefore, the overall antenna bandwidth is limited by the impedance bandwidth. In other words, the measured overall antenna bandwidth is 12.5% (24.7-28.0 GHz).

Figures 14A, 14B:
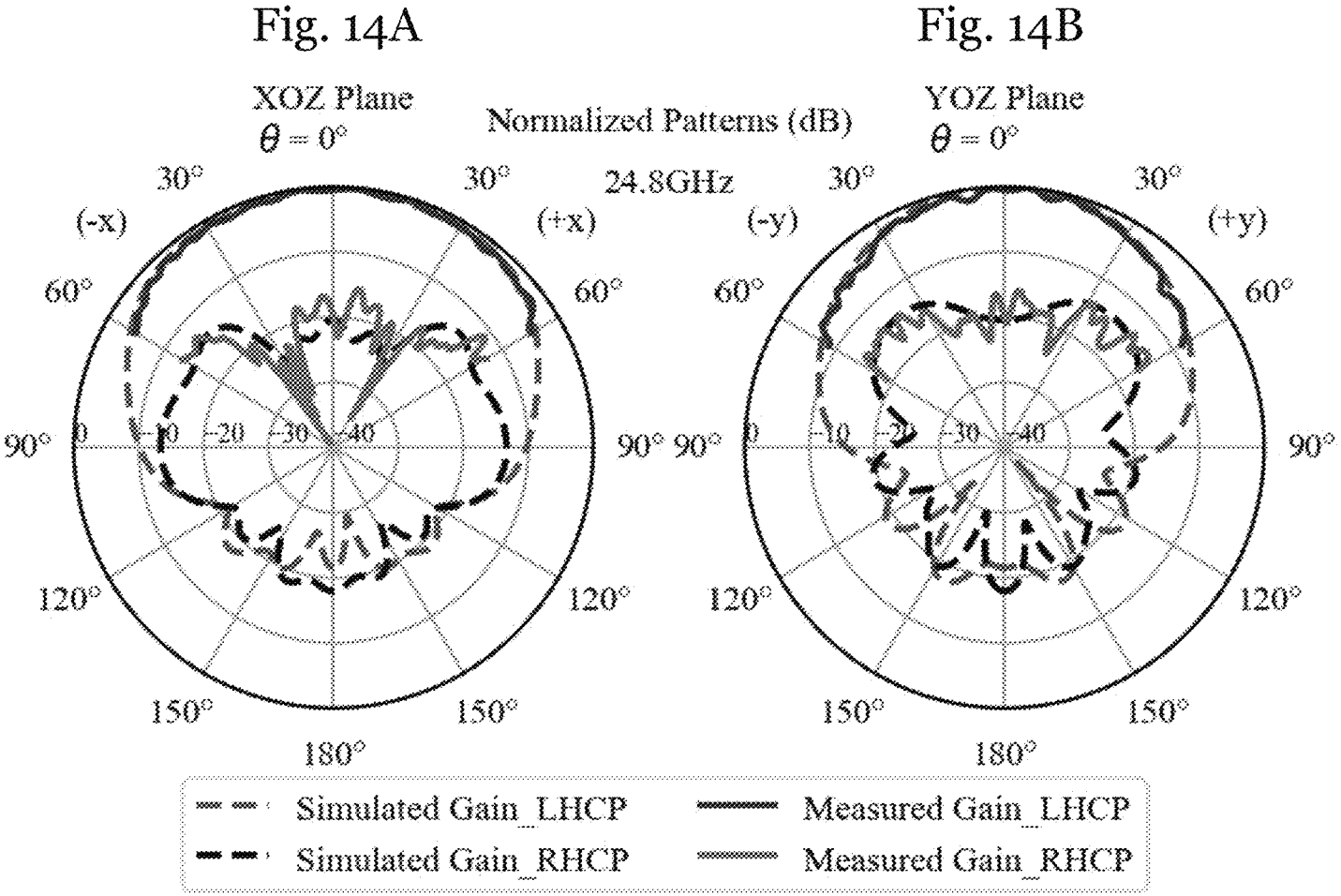
FIG. 14A is a plot showing measured and simulated radiation patterns of the parallel-plate antenna of FIG. 9 in the XOZ plane at 24.4 GHz.
FIG. 14B is a plot showing measured and simulated radiation patterns of the parallel-plate antenna of FIG. 9 in the YOZ plane at 24.4 GHz.
Figures 15A, 15B:
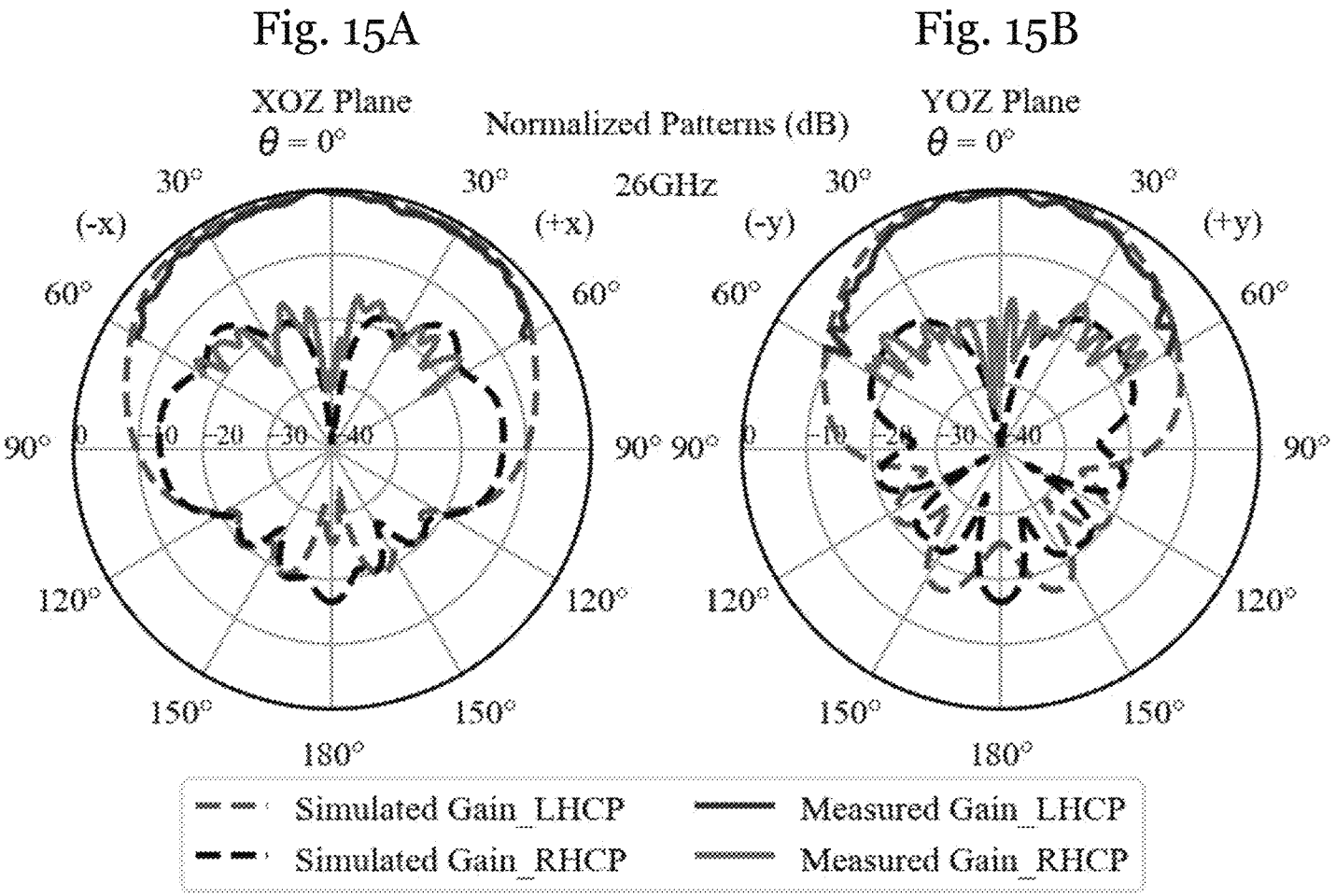
FIG. 15A is a plot showing measured and simulated radiation patterns of the parallel-plate antenna of FIG. 9 in the XOZ plane at 26 GHz.
FIG. 15B is a plot showing measured and simulated radiation patterns of the parallel-plate antenna of FIG. 9 in the YOZ plane at 26 GHz.
Figures 16A, 16B:
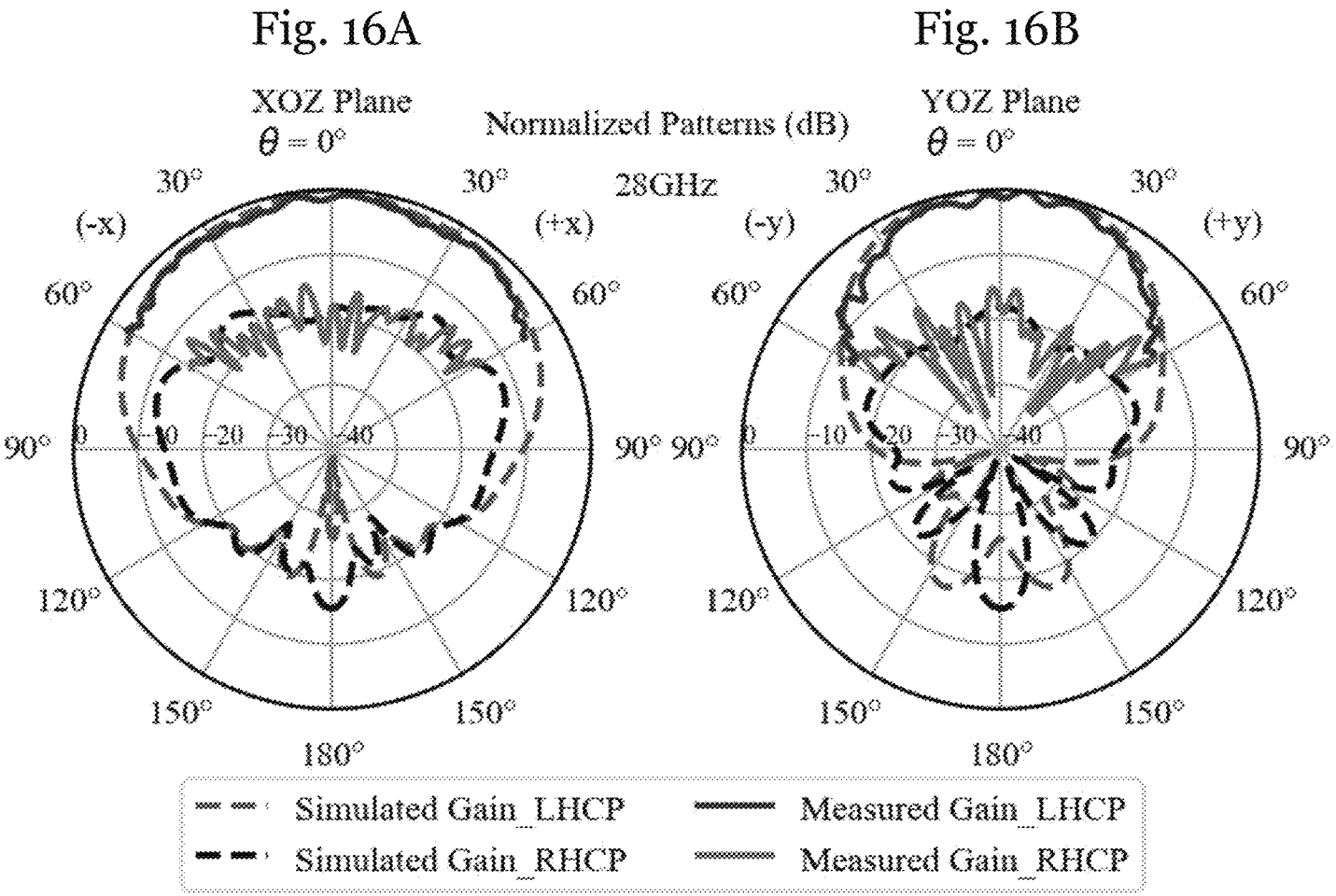
FIG. 16A is a plot showing measured and simulated radiation patterns of the parallel-plate antenna of FIG. 9 in the XOZ plane at 28.8 GHz.
FIG. 16B is a plot showing measured and simulated radiation patterns of the parallel-plate antenna of FIG. 9 in the YOZ plane at 28.8 GHz.

FIGS. 14A and 14B show the measured and simulated radiation patterns of the antenna 1000 in the XOZ plane and the YOZ plane respectively, at 24.4 GHz; FIGS. 15A and 15B show the measured and simulated radiation patterns of the antenna 1000 in the XOZ plane and the YOZ plane respectively, at 26 GHz; FIGS. 16A and 16B show the measured and simulated radiation patterns of the antenna 1000 in the XOZ plane and the YOZ plane respectively, at 28.8 GHz. Since the patterns at different frequencies are very similar, only the patterns at 26 GHz (FIGS. 15A and 15B) are discussed in detail below.

As shown in FIGS. 15A and 15B, wide measured 3-dB co-polar beamwidths of 94° and 60° are found in the $\phi=0°$- and $\phi=90°$-plane results, respectively. Based on the fact that the axial ratio is 3 dB when the difference between the co- and cross-polar fields is 15 dB, it can be found from FIGS. 15A and 15B that the measured 3-dB axial ratio beamwidths are 94° and 58° in the $\phi=0°$ and $\phi=90°$ planes, respectively. In the boresight direction, the co-polar circularly polarized field is stronger than the cross-polar circularly polarized field by more than 25 dB. It is noted that the use of the semicircular plates in the antenna 1000 makes the cross-polar field in the $\phi=0°$ plane now desirably much weaker than that of in the antenna 200. Also, the $\phi=0°$-plane pattern of the semicircular design in the antenna 10000 is much smoother than that of the rectangular design in the antenna 200 because the corner diffractions are now substantially reduced or eliminated.

Next, a parametric study was performed to identify parameters that are critical to the performance of the antennas 200, moo. The following description makes reference of antenna moo.

Figure 17:
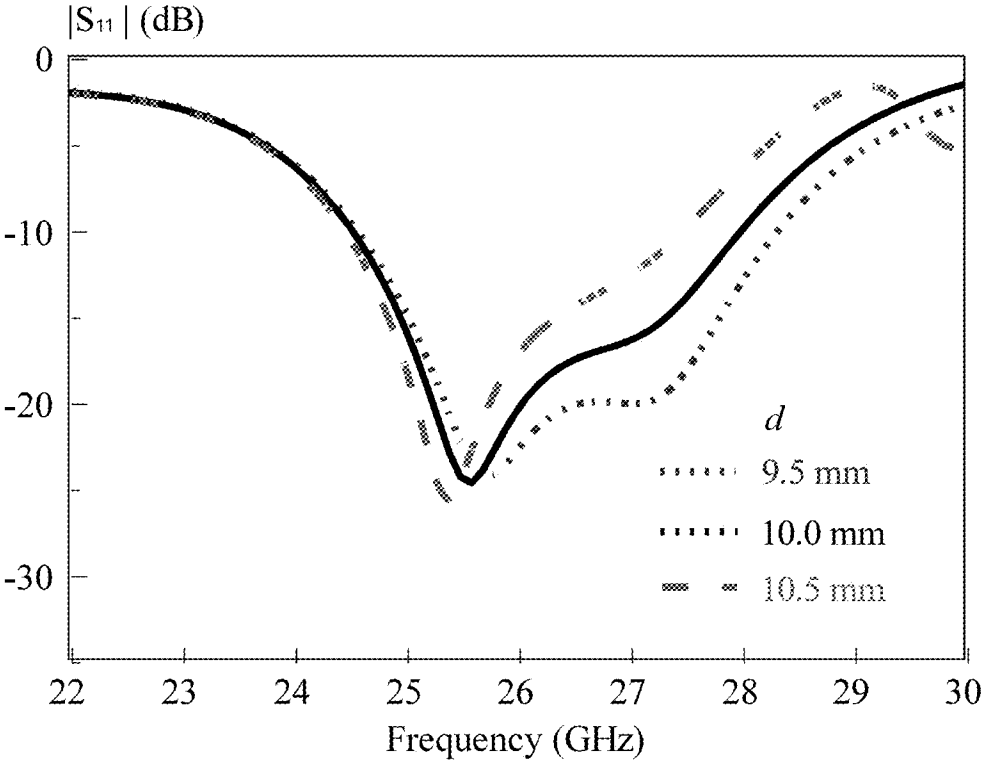
FIG. 17 is a graph showing simulated reflection coefficients (dB) of the parallel plate antenna in FIG. 9 at different frequencies (GHz) for different separations d between the parallel plates (mm)
Figure 18:
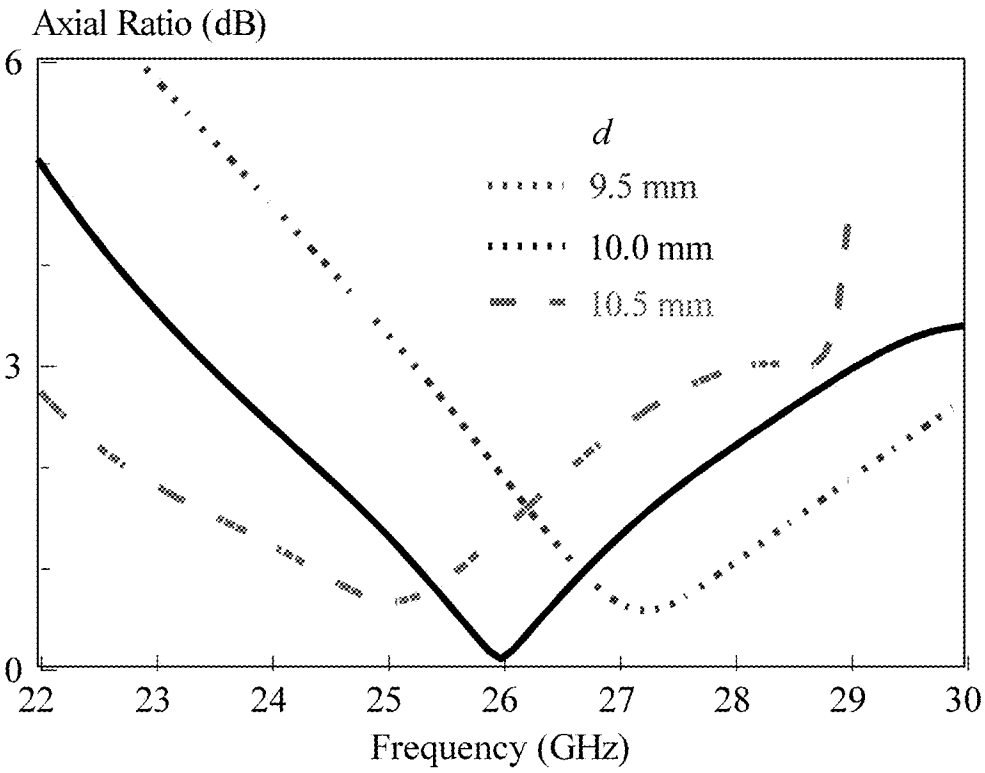
FIG. 18 is a graph showing simulated axial ratios (dB) of the parallel plate antenna in FIG. 9 at different frequencies (GHz) for different separations d between the parallel plates (mm)

FIGS. 17 and 18 show the effect of the plate separation d on the performance (reflection coefficients and axial ratios) of the antenna moo. As shown in FIG. 17, when the separation d between the plates increases from 9.5 mm to 10.5 mm, the reflection coefficient changes only slightly but the axial ratio frequency $f_0$ dramatically shifts from 27.3 GHz to 25.1 GHz. This result suggests that d can be used to adjust the axial ratio frequency $f_0$ without significantly affecting the matching. It should be noted that in both FIGS. 17 and 18 there are abrupt changes at around 29 GHz. This is expected because of the excitation of a third propagating mode ($TE_2$ mode) in the parallel-plate waveguide. In an infinitely large parallel-plate waveguide with a plate separation of 10.5 mm, the theoretical cutoff frequency of the $TE_2$ mode is 28.57 GHz, which reasonably agrees with the result of FIGS. 17 and 18.

Figure 19:
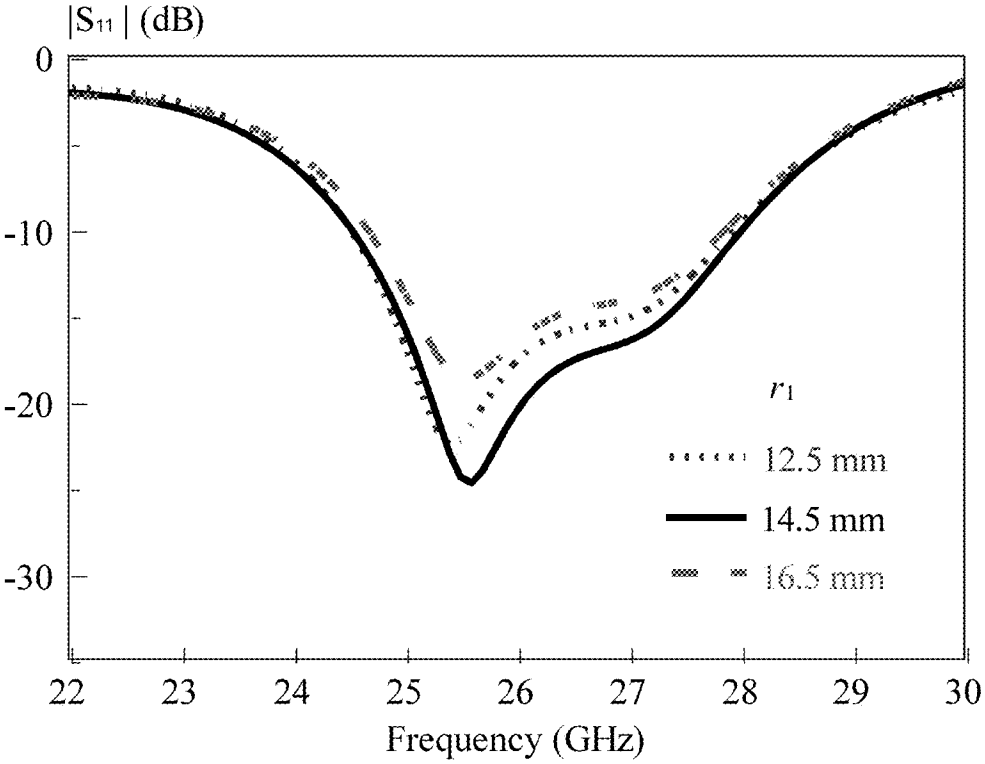
FIG. 19 is a graph showing simulated reflection coefficients (dB) of the parallel plate antenna in FIG. 9 at different frequencies (GHz) for different plate radius r (mm)
Figure 20:
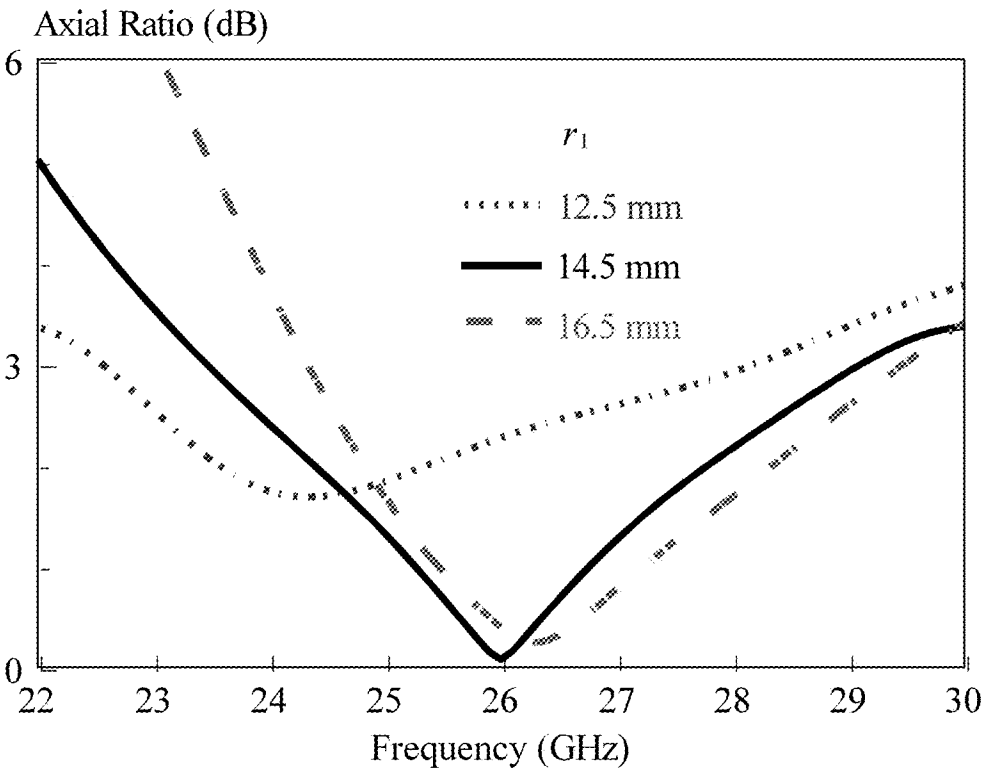
FIG. 20 is a graph showing simulated axial ratios (dB) of the parallel plate antenna in FIG. 9 at different frequencies (GHz) for different plate radius r (mm)

FIGS. 19 and 20 show the effects of plate radius $r_1$ on the performance (reflection coefficients and axial ratios) of the antenna moo. As shown in the Figures, the radius $r_1$ affects the axial ratio of the antenna 1000 much more than the reflection coefficient of the antenna moo. Hence, $r_1$ can be used to tune the axial ratio with only minor effects on the matching.

Figure 21:
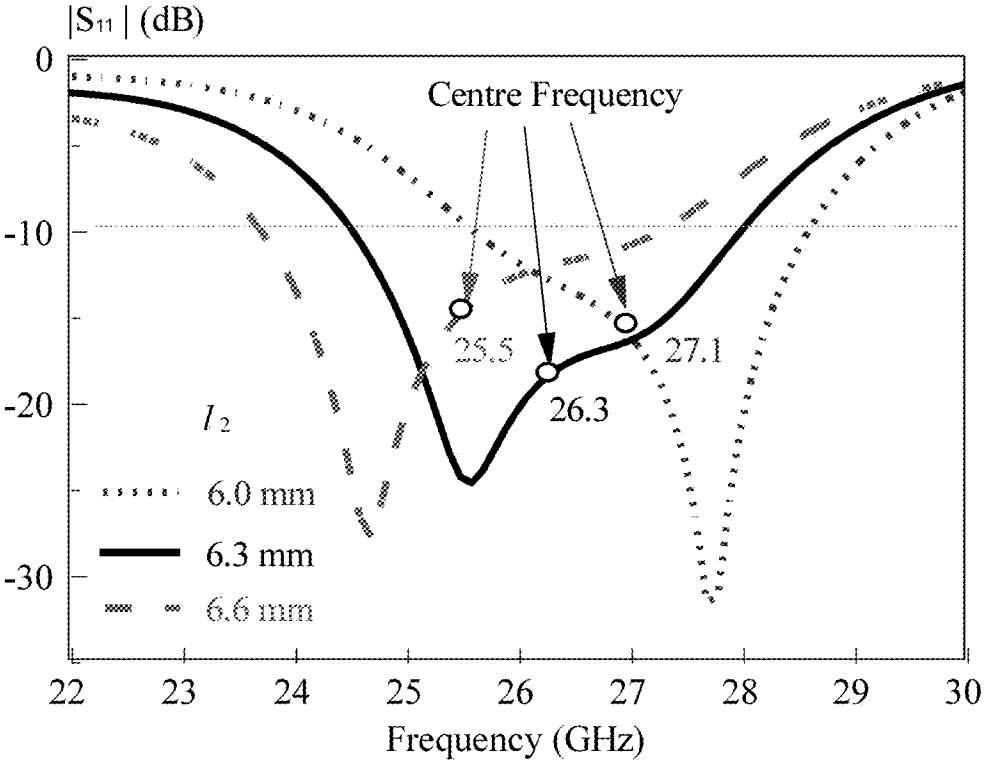
FIG. 21 is a graph showing simulated reflection coefficients (dB) of the parallel plate antenna in FIG. 9 at different frequencies (GHz) for different slot length $l_2$ (mm).

FIG. 21 studies the effect of the slot length $l_2$ on the reflection coefficient. As seen from FIG. 21, the impedance frequency decreases monotonically with an increase in $l_2$. The effect of $l_2$ on the axial ratio was also studied and it was found that the axial ratio remains generally unchanged as $l_2$ varies. This suggests that $l_2$ can be adjusted to tune the impedance frequency independently.

The effect of the waveguide length $l_4$ was studied by increasing $l_4$ from 8.0 mm to 30.0 mm. It was found that the reflection coefficient repeats for every 8.0 mm, which is half of the guided wavelength of the waveguide-to-coaxial adapter (waveguide section). It was also found that $l_4$ can be adjusted to tune the matching without affecting the impedance frequency. Moreover, it generally does not affect the axial ratio, hence it can be adjusted to tune the matching independently. It greatly facilitates antenna design.

Finally, the effect of the slot angle $\alpha$ on the antenna 1000 was studied by increasing a from 32° to 40°. It was found that a only gently affects both the matching and axial ratio and therefore it can be used to fine-tune the antenna 1000. It should be mentioned that a is best to be close to about 45°, for example between 30° and 60°, in order to properly obtain circularly polarized fields.

The above antenna embodiments 100, 200, 900, 1000 of the invention can be used in communication systems to improve quality of service by providing reliable wireless links in a complex electromagnetic environment. For example, the antenna(s) can be adapted at the terminal end of a communication system, especially for 5G mmWave devices. The antenna(s) may be integrated into an antenna array.

The above antenna embodiments of the invention can provide a simple and effective circularly polarized broad-beam antenna suitable for use in, e.g., mobile wireless communication systems. The radiation efficiency and fabrication complexity (ease of fabrication) of the antenna(s) are balanced thus making it effective and relatively simple to make. The radiation characteristics of the antenna(s) are relatively stable across a wide bandwidth. Compared with some existing broad-beam antennas, the antenna embodiments of the invention have simpler and larger structures, and so are easier and cheaper to make accurately, especially for applications in millimeter-wave frequencies.

It will be appreciated by persons skilled in the art that numerous variations and/or modifications may be made to the invention as shown in the specific embodiments. The described embodiments of the invention should therefore be considered in all respects as illustrative, not restrictive.

For example, the antenna can be implemented in the design of an antenna array, in which there are multiple antennas as described. The dimension, shape, form, and dimensions of the ground plane and the plates can vary (different from illustrated). The feed for the slot can take any form, not necessarily a waveguide to coaxial adapter. For example, the slot may be directly or indirectly connected to other signal sources. The antenna can be designed for operation in other or further frequencies or frequency bands, not necessarily the millimeter wave bands. The antenna or the antenna element can be made using metallic, plastic, dielectric materials. The antenna or the antenna element can be assembled from components or can be made integrally.

The invention claimed is:

1. An antenna, comprising:

an antenna element having a ground plane with a slot elongated along a slot extension axis; and a pair of parallel plates connected to the ground plane, each of the parallel plates having a length extending parallel to a plate extension axis, the parallel plates extending generally perpendicularly from the ground plane, and, in plan view, the slot being arranged between the parallel plates; and a feed operably coupled with the slot for feeding the slot during operation so as to generate a circularly polarized signal for radiation;

wherein the antenna has a working frequency, and wherein the feed is arranged to feed the slot so as to create a phase difference between orthogonal modes of operation at the working frequency for generation of the circularly polarized signal; and wherein an angle between the slot extension axis and the plate extension axis is between 30 degrees to 60 degrees.

2. The antenna of claim 1, wherein the slot is generally rectangular, obround, or oblong.

3. The antenna of claim 1, wherein the angle is between 40 degrees to 50 degrees.

4. The antenna of claim 1, wherein the angle is about 45 degrees.

5. The antenna of claim 1, wherein the slot is arranged centrally of the ground plane.

6. The antenna of claim 1, wherein the parallel plates are of the same shape and size.

7. The antenna of claim 6, wherein the parallel plates are generally symmetrically disposed with reference to the ground plane.

8. The antenna of claim 7, wherein each of the parallel plates is in the form of a rectangular prism.

9. The antenna of claim 7, wherein each of the parallel plates is in the form of a semi-circular prism.

10. The antenna of claim 1, wherein the ground plane defines a footprint, and, in plan view, the parallel plates and the feed are within the footprint.

11. The antenna of claim 1, wherein the ground plane has a top from which the parallel plates extend, and a bottom, wherein the bottom of the ground plane defines a cavity, the cavity at least partly receiving the feed.

12. The antenna of claim 11, wherein the feed comprises a waveguide-to-coaxial adapter including a feed waveguide and a feed probe attached to the feed waveguide.

13. The antenna of claim 12, wherein the feed waveguide has opposite first and second ends, wherein the first end is received in the cavity and the second end is a shorted-end.

14. The antenna of claim 13, wherein the feed waveguide extends generally perpendicular to the ground plane and the feed probe extends generally parallel to the ground plane.

15. The antenna of claim 14, wherein the feed probe is connected between the first and second ends of the feed waveguide.

16. The antenna of claim 1, wherein the antenna element is integrally formed.

17. The antenna of claim 1, wherein the antenna element is metallic.

18. The antenna of claim 1, wherein the antenna is adapted for operation in the mmWave band.

19. An antenna array comprising:

an antenna element array having a ground plane;

three or more parallel plates connected to the ground plane, each of the parallel plates having a length extending parallel to a plate extension axis, the parallel plates extending generally perpendicularly from the ground plane; and a plurality of slots formed in the ground plane, each of the slots being arranged between adjacent parallel plates of the three or more parallel plates and being elongated along a respective slot extension axis; and one or more feeds operably coupled with the plurality of slots for feeding the slots during operation so as to simultaneously generate a plurality of circularly polarized signals for radiation;

wherein the antenna array has a working frequency, and the one or more feeds are arranged to feed the slots so as to create a phase difference between orthogonal modes of operation at the working frequency for generation of the circularly polarized signals; and wherein an angle between each of the respective slot extension axis and the plate extension axis is between 30 degrees to 60 degrees.

20. A communication device comprising one or more of the antennas of claim 1.

21. The antenna array of claim 19, wherein the angle is between 40 degrees to 50 degrees.

22. The antenna array of claim 19, wherein the angle is about 45 degrees.

23. The antenna array of claim 19, wherein the antenna array is adapted for operation in the mmWave band.

* * * * *